US007117959B2

(12) United States Patent
Lah

(10) Patent No.: US 7,117,959 B2
(45) Date of Patent: Oct. 10, 2006

(54) SYSTEMS AND METHODS FOR REMOTELY DETERMINING AND CHANGING CUTTING MODES DURING DECOKING

(75) Inventor: Ruben F. Lah, West Jordan, UT (US)

(73) Assignee: Curtiss-Wright Flow Control Corporation, RoseLand, NJ (US)

( * ) Notice: Subject to any disclaimer, the term of this patent is extended or adjusted under 35 U.S.C. 154(b) by 21 days.

(21) Appl. No.: 10/997,234

(22) Filed: Nov. 24, 2004

(65) Prior Publication Data

US 2005/0236188 A1 Oct. 27, 2005

Related U.S. Application Data

(60) Provisional application No. 60/564,449, filed on Apr. 22, 2004.

(51) Int. Cl.
*E21B 7/18* (2006.01)

(52) U.S. Cl. ..... 175/67; 134/95.3; 166/222

(58) Field of Classification Search ..... 175/424, 175/67, 70; 166/222, 223; 134/95.3
See application file for complete search history.

(56) References Cited

U.S. PATENT DOCUMENTS

| | | | | |
|---|---|---|---|---|
| 2,245,554 | A | 6/1941 | Court | 141/1 |
| 3,646,947 | A * | 3/1972 | Rochelle et al. | 134/167 C |
| 4,275,842 | A | 6/1981 | Purton et al. | 239/446 |
| 4,611,613 | A * | 9/1986 | Kaplan | 134/95.3 |
| 4,923,021 | A * | 5/1990 | Courmier et al. | 175/382 |
| 5,107,873 | A * | 4/1992 | Clinger | 134/56 R |
| 5,816,505 | A * | 10/1998 | Tran et al. | 239/443 |
| 6,644,567 | B1 * | 11/2003 | Adams et al. | 239/566 |
| 2004/0118746 | A1 | 6/2004 | Wilborn et al. | 208/131 |

* cited by examiner

*Primary Examiner*—David Bagnell
*Assistant Examiner*—Daniel P Stephenson
(74) *Attorney, Agent, or Firm*—Kirton & McConkie; Michael F. Krieger

(57) ABSTRACT

A decoking system that not only enables an operator to remotely switch the coke-cutting process from boring to cutting mode without removing the drill stem from the coke drum, but also to remotely determine the drill stem's mode so that efficiency, safety and convenience are not compromised, is provided.

26 Claims, 10 Drawing Sheets

SYSTEMS AND METHODS FOR REMOTELY DETERMINING AND CHANGING CUTTING MODES DURING DECOKING

RELATED APPLICATIONS

This application claims priority to U.S. Provisional Patent Application Ser. No. 60/564,449 filed Apr. 22, 2004.

FIELD OF INVENTION

The present invention relates to a system for removing solid carbonaceous residue (hereinafter referred to as "coke") from large cylindrical vessels called coke drums. This removal process is often referred to as "decoking." More particularly, the present invention relates to a system that allows an operator to remotely activate the cutting of coke within a coke drum and at the same time, apprises the operator of the status of the cutting modes taking place within the coke drum during the coke-cutting process. Hence, the present invention provides a system for cutting coke within a coke drum with increased safety, efficiency and convenience.

BACKGROUND

Petroleum refining operations in which crude oil is processed to produce gasoline, diesel fuel, lubricants and so forth, frequently produce residual oils. Residual oil, when processed in a delayed coker is heated in a furnace to a temperature sufficient to cause destructive distillation in which a substantial portion of the residual oil is converted, or "cracked" to usable hydrocarbon products and the remainder yields petroleum coke, a material composed mostly of carbon. Many oil refineries recover valuable products from the heavy residual hydrocarbons, which remain following delayed coking.

Generally, the delayed coking process involves heating the heavy hydrocarbon feed from a fractionation unit, then pumping the heated heavy feed into a large steel vessel commonly known as a coke drum. The unvaporized portion of the heated heavy feed settles out in the coke drum, where the combined effect of retention time and temperature causes the formation of coke. Vapors from the top of the coke vessel are returned to the base of the fractionation unit for further processing into desired light hydrocarbon products. The operating conditions of delayed coking can be quite severe. Normal operating pressures in coke drums typically range from twenty-five to fifty pounds per square inch. Additionally, the heavy feed input temperature may vary between 800° F. and 1000° F.

The structural size and shape of the coke drum varies considerably from one installation to another. However, the typical coke drum is a large, upright, cylindrical, metal vessel commonly ninety to one-hundred feet in height, and twenty to thirty feet in diameter. Coke drums have a top head and a funnel shaped bottom portion fitted with a bottom head. Coke drums are usually present in pairs so that they can be operated alternately. Coke settles out and accumulates in a vessel until it is filled, at which time the heated feed is switched to the alternate empty coke drum. While one coke drum is being filled with heated residual oil, the other vessel is being cooled and purged of coke.

Coke removal, also known as decoking, begins with a quench step in which steam and then water are introduced into the coke filled vessel to complete the recovery of volatile, light hydrocarbons and to cool the mass of coke.

After a coke drum has been filled, stripped and then quenched so that the coke is in a solid state and the temperature is reduced to a reasonable level, quench water is drained from the drum through piping to allow for safe unheading of the drum. The drum is then vented to atmospheric pressure when the bottom opening is unheaded, to permit removing coke. Once the unheading is complete, the coke in the drum is cut out of the drum by high pressure water jets.

Decoking is accomplished at most plants using a hydraulic system comprised of a drill stem and drill bit that direct high pressure water jets (2600–3600 p.s.i.) into the coke bed. A rotating combination drill bit, referred to as the cutting tool, is typically about eighteen inches in diameter with several nozzles, and is mounted on the lower end of a long hollow drill stem about six inches in diameter. The drill bit is lowered into the vessel, on the drill stem, through a flanged opening at the top of the vessel. A "bore hole" is drilled through the coke using the nozzles, which eject high pressure water at an angle approximately sixty degrees down from horizontal. This creates a pilot bore hole, about three to six feet in diameter, for the coke to fall through.

After the initial bore hole is complete, the drill bit is then mechanically switched to at least two horizontal nozzles in preparation for cutting the "cut" hole, which extends to the full drum diameter. In the cutting mode the nozzles shoot jets of water horizontally outwards, rotating slowly with the drill rod, and those jets cut the coke into pieces, which fall out the open bottom of the vessel, into a chute that directs the coke to a receiving area. In all employed systems the drill rod is then withdrawn out the flanged opening at the top of the vessel. Finally, the top and bottom of the vessel are closed by replacing the head units, flanges or other closure devices employed on the vessel unit. The vessel is then clean and ready for the next filling cycle with the heavy hydrocarbon feed.

In the typical coke-cutting system, after the boring hole is made, the drill stem must be removed from the coke drum and reset to the cutting mode. This takes time, is inconvenient and is potentially hazardous. In less typical systems the modes are automatically switched. Automatic switching within the coke drum oftentimes results in drill stem clogging, which still requires the drill stem to be removed for cleaning prior to completing the coke-cutting process. Often, in automatic switching systems, it is difficult to determine whether or not the drill stem is in cutting or boring mode, because the entire change takes place within the drum. Mistakes in identifying whether the high pressure water is cutting or boring lead to serious accidents. Thus, coke-cutting efficiency is compromised because the switching operator does not know whether or not the cutting process is complete or simply clogged.

Decoking is dangerous work. Serious incidents occur each year in connection with coke-cutting operations. OSHA Report entitled *Hazards of Delayed Coker Unit (DCU) Operations*, found at http://www.osha.gov/dts/shib/shib082903c.html (Aug. 29, 2003) which details several safety hazards associated with decoking. OSHA's report describes some of the most frequent and severe hazards. Id. The OSHA's report explains that if the hydro-cutting system is not shut off before the drill stem is raised out of the top drum opening, operators are exposed to the high-pressure water jet and serious injuries including dismemberment occur. Id. Additionally, the report adds that fugitive mists and vapors from the cutting and the quench water contain contaminants posing a health hazard. Id. Further, the water hose occasionally bursts while under high pressure, resulting in a whipping action that may seriously injure nearby workers. Alternatively, the wire rope supporting the drill stem and water hose could fail, allowing the drill stem, water hose, and wire rope to fall onto work areas. Id. Finally, gantry damage may occur, exposing workers to falling structural members and equipment. Id. Thus, operators are exposed to significant safety hazards from exposure to high pressure water jets, steam, hot water and fires because operators must be present, in close proximity to the vessel being decoked, to manually change the cutting head from the boring to cutting mode. Accordingly, the industry has concentrated most of their technological improvements in the field of coking to minimize the safety hazards.

Steps taken to control hazards inherent in coke-cutting systems consist of providing protective wear to the operators, requiring personnel training, maintaining equipment so that it is fail-proof, and allowing remote operation of certain steps of the decoking process (e.g., "deheading"). Despite efforts to reduce the hazards associated with decoking, there still exists a need for improved safety.

SUMMARY AND OBJECTS OF THE INVENTION

The present invention relates to a system for removing solid carbonaceous residue, referred to as "coke," from large cylindrical vessels called coke drums. The present invention relates to a system that allows an operator to remotely activate the cutting of coke within a coke drum, and to remotely switch between the "boring" and the "cutting" modes, while cutting coke within a coke drum reliably, and without raising the drill bit out of the coke drum for mechanical alteration or inspection. Further, the present invention allows an operator to determine the status of the cutting modes taking place within the coke drum during the coke-cutting process. Hence, the present invention provides a system for cutting coke within a coke drum with increased safety, efficiency and convenience.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

One embodiment of the present invention features the use of a three-wall ball valve, a union and a specialized drill bit. In this preferred embodiment, the system is comprised of a cutting liquid tank filled with water or other liquid. A pipe is attached to this tank and water flows from it into a high-pressure pump. In the high-pressure pump, the water is pressurized. After leaving the high-pressure pump, the pressurized water then flows into another pipe which divides into two pipes. One of the two pipes created from this division is a boring water delivery pipe and the other is a cutting water delivery pipe. In one embodiment of the present invention the delivery pipe is separated into two pipes by a three-way ball valve. The three-way ball valve prevents the pressurized water from flowing into both pipes simultaneously. Further, an operator may visualize with certainty which pipe the pressurized water is in, and consequently, the status of coke-cutting mode within the coke drum.

The two pipes extend parallel to each other for a distance. After such a distance, the two delivery pipes integrate to form an integrated boring and cutting water delivery pipe. This integrated boring and cutting water delivery pipe appears as a "pipe within a pipe." Specifically, the boring water delivery pipe becomes an inner pipe, while the cutting water delivery pipe concentrically encompasses the boring water delivery pipe on the outside becoming an outer pipe. The two pipes do not fluidly communicate with each other. The two pipes enable pressurized fluid to flow through either of the two pipes to the same overall device, the cutting head. Because the switch valve allows water to flow only through either the inner, boring water delivery pipe, or the outer delivery pipe, cutting water deliver pipe, water is delivered only to boring or cutting outlet nozzles of the cutting head respectively. In another embodiment, the two pipes run parallel until reaching a union at the top of the drilling stem.

The integrated boring and cutting water delivery pipe attaches to, or is an integral part of a union. From a lower part of the union, a rotatable integrated boring and cutting drill stem, with the same dimensions and diameters as the integrated boring and cutting delivery pipe, extends vertically downward. This rotatable integrated boring and cutting drill stem features a motor that is also activated by the external switch. The motor enables the drill stem to rotate. The similarity in dimensions enables the integrated boring and cutting water delivery pipe to fluidly communicate with the drill stem. At the same time, the union between the two pipes prevents the integrated boring and water delivery pipe from rotating yet allows the rotatable integrated boring and cutting drill stem to rotate. The rotatable integrated boring and cutting drill stem has an inner pipe and an outer pipe. At a lower end of the drill stem, there is a cutting head with nozzles that allow the pressurized water to be ejected therethrough to cut the coke away from the interior of the coke drums. The cutting head has boring and cutting nozzles. The boring nozzles eject high pressure fluid in a downward angle to produce the bore hole, and the cutting nozzles eject high pressure fluid in a direction roughly perpendicular to the drill stem.

The rotatable integrated boring and cutting drill stem is activated by a remote switching means. One embodiment of the present invention is characterized by the feature that high pressure fluid cannot flow into the cutting nozzles and the boring nozzles of a cutting head at the same time. After the cutting head has been inserted into the top of the coke drum, pressurized fluids are ejected through a plurality of nozzles in the cutting head at a pressure sufficient to cut and dislodge coke from the vessel. When an operator actuates the switch valve pressurized fluids are allowed to flow into the boring water delivery pipe through the union into the inner pipe of the integrated boring and cutting drill stem, into the cutting head and out one or more nozzles dedicated to cutting the bore hole in the coke. As the cutting head descends through the coke barrel, pressurized water enters the drill stem through the inner pipe ejecting fluid through a plurality of nozzles attached to the cutting head at a pressure sufficient to bore coke from the vessel. Thus, a bore hole is drilled through the coke using the nozzle or plurality of nozzles, which eject high pressure liquids in a downward direction from the cutting head.

After the initial bore hole is completed, the flow of high pressure fluid is remotely switched to a plurality of nozzles attached to the cutting head at a pressure sufficient to cut and dislodge the remainder of coke from the vessel. This switching is accomplished by actuating a switch valve, which is in a position remote from the coke barrel. In one embodiment of the present invention the operator remotely switches the flow of fluid from the boring nozzles to the cutting nozzles by turning the handle of a three-way ball valve, which is in a location remote from the vessel being decoked. Thus, when the cutting head has successfully completed its boring stroke the switch valve is activated allowing pressurized fluid to flow into the cutting water delivery pipe, but not into the boring water delivery pipe. The pressurized fluid flows through the cutting water delivery pipe then enters the outer pipe of the integrated boring and cutting drill stem and is ejected from the cutting nozzles of the cutting head to begin cutting the coke away from the interior of the coke drum. Subsequently, the remainder of coke in the drum is cut and dislodged from the vessel.

Thus, the entire boring and cutting processes are activated by the external switch, which activates the switch valve located where the pipe divides into the boring water delivery pipe and the cutting water delivery pipe. The process is controlled by the external switch mechanism. Therefore, the operator is able to determine which mode, either boring or cutting, the rotatable integrated boring and cutting drill stem is in without having to remove the cutting head from the coke drum during the entire coke-cutting process.

In some embodiments of the present invention, the switch valve is controlled by a central processing unit, or other means, rather than a live operator. Thus, it is contemplated by the present invention that the switch valve could be controlled from a control room wherein an operator remotely controls the entire decoking process utilizing mechanical and electrical apparatus to remotely dictate the flow during the decoking process. The present invention comprises several objectives which achieve previously unknown models of efficiency and safety in the art. Accordingly, it is an object of some embodiments of the present invention to provide a system for cutting coke that is controlled from a remote location through an external switching mechanism. The present invention provides a system for coke-cutting wherein the drill stem does not need to be removed to change from boring to cutting mode, but rather, modes can be changed remotely from boring to cutting or from cutting to boring. The present invention provides a system for coke-cutting, wherein the rotatable integrated boring and cutting drill stem does not clog because switching from boring to cutting is controlled by a remote switch, precluding both modes from operating simultaneously.

The present invention provides a system for coke-cutting, wherein a physical symbol is connected to said switch valve so that the operational status, i.e., boring and cutting modes, is manifested externally to an operator. The present invention provides a system for coke-cutting can be used with current coke-cutting techniques.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE PREFERRED EMBODIMENTS

Figure 1:
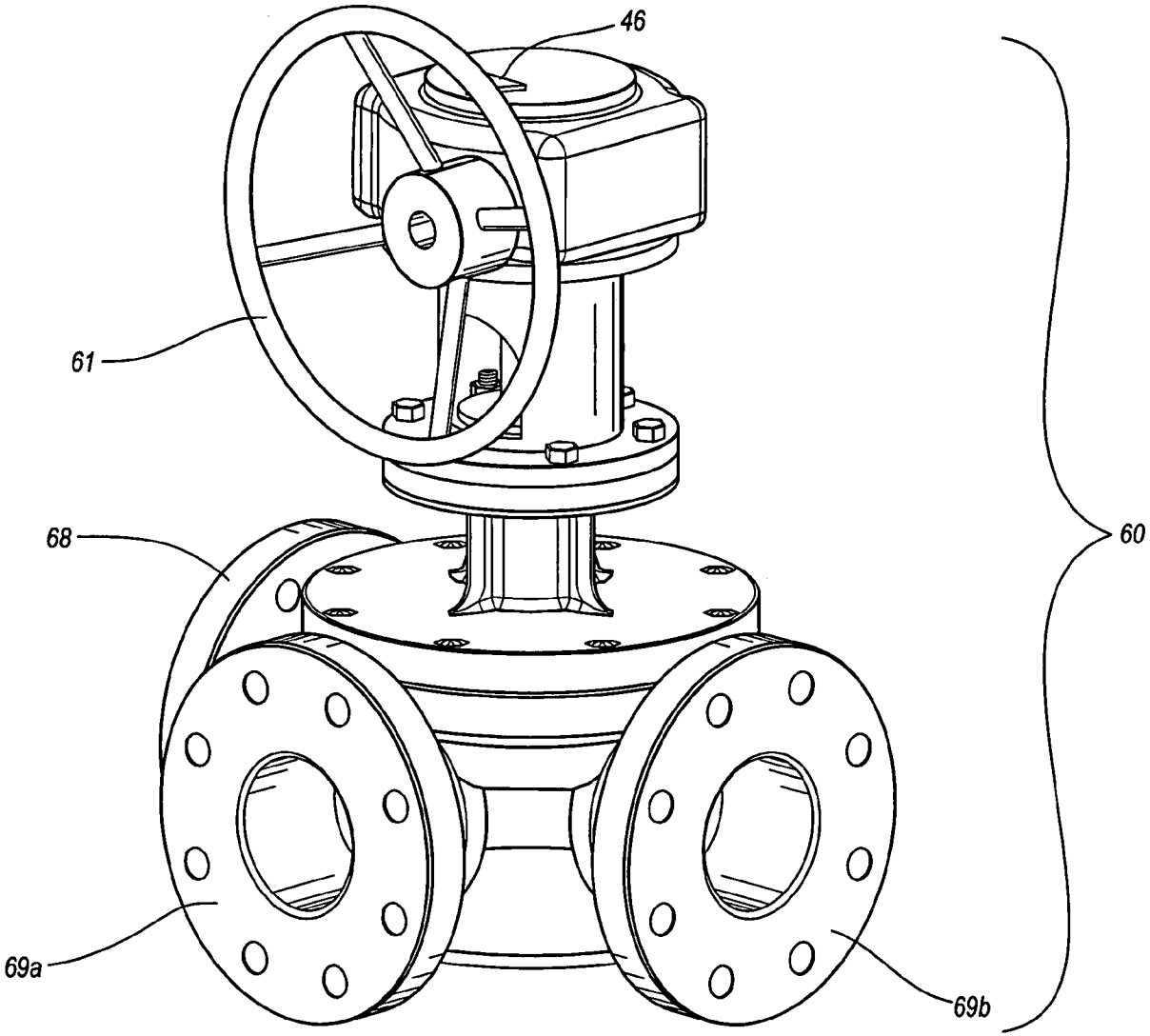
FIG. 1 depicts a 3-way ball joint, which is an embodiment of a switch valve.
Figure 2:
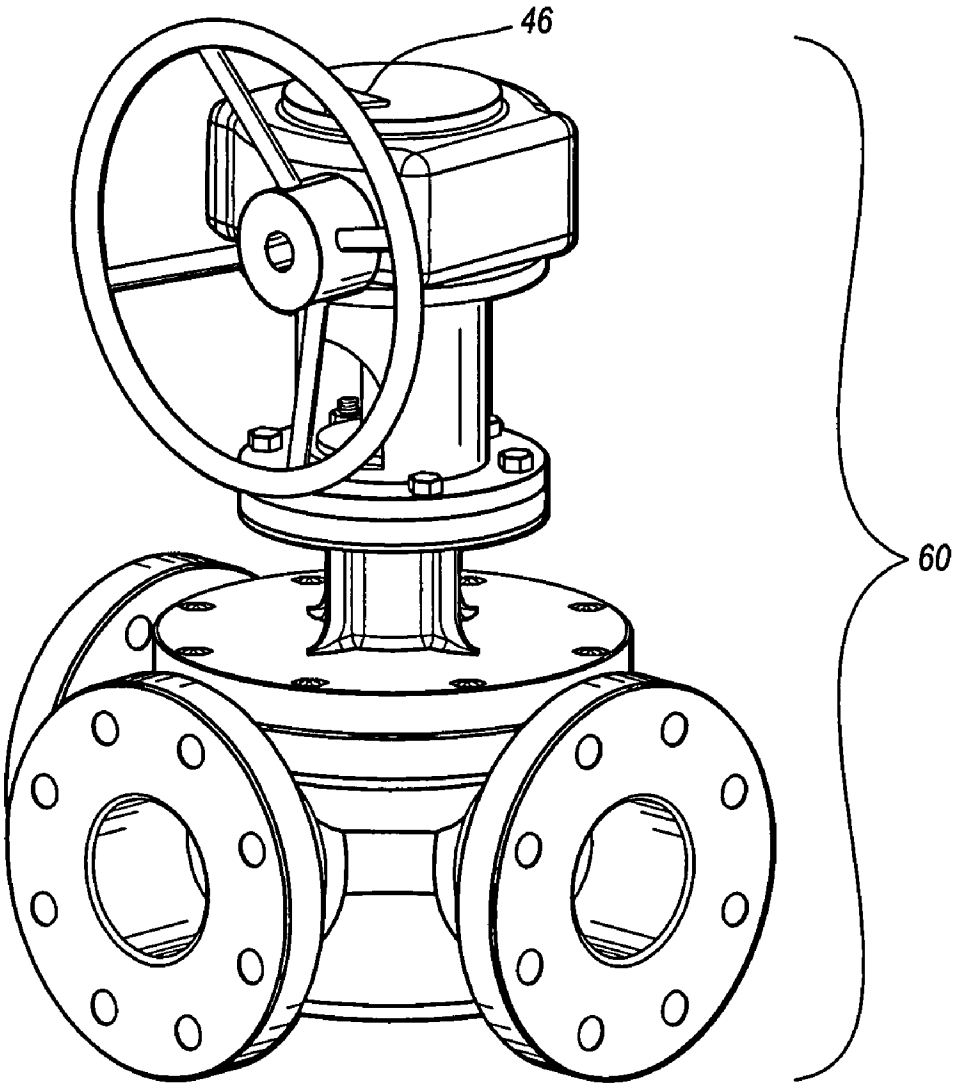
FIG. 2 depicts an embodiment of a switch valve which is a 3-way valve joint.
Figure 3:
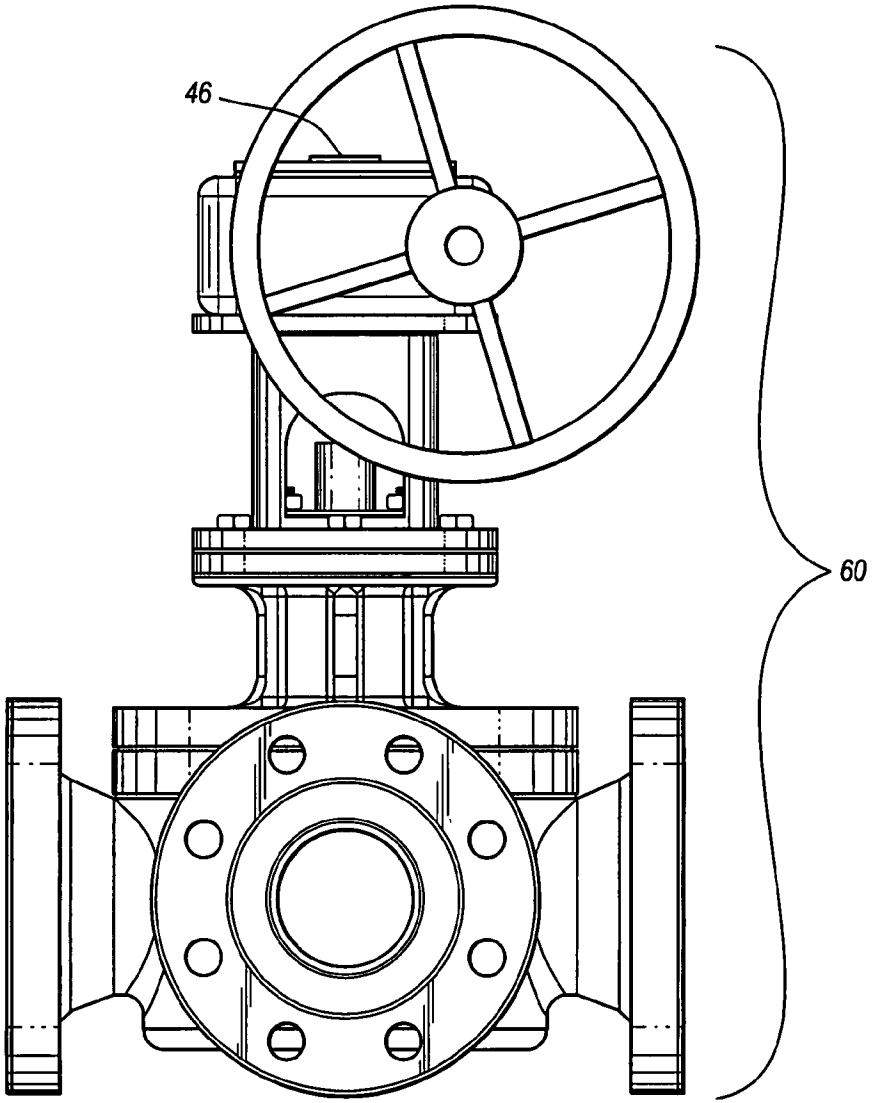
FIG. 3 depicts an embodiment of a switch valve which is a 3-way valve joint.
Figure 4:
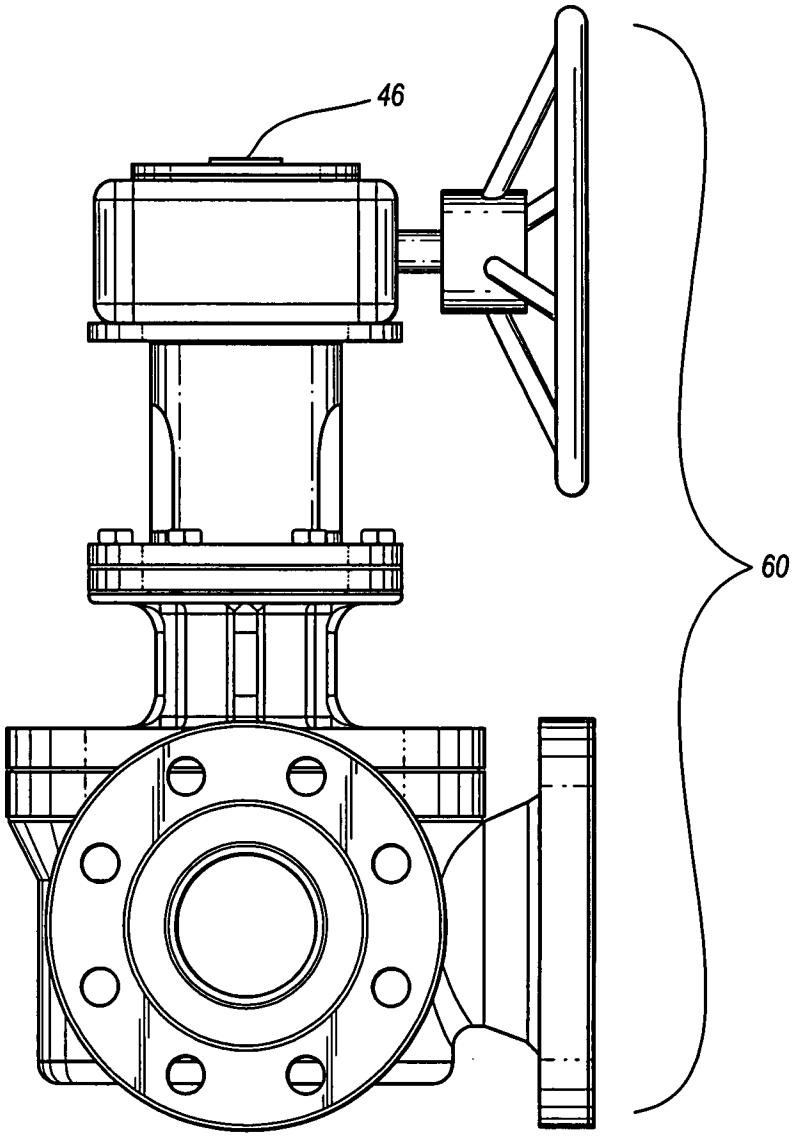
FIG. 4 depicts an embodiment of a switch valve which is a 3-way valve joint.
Figure 5:
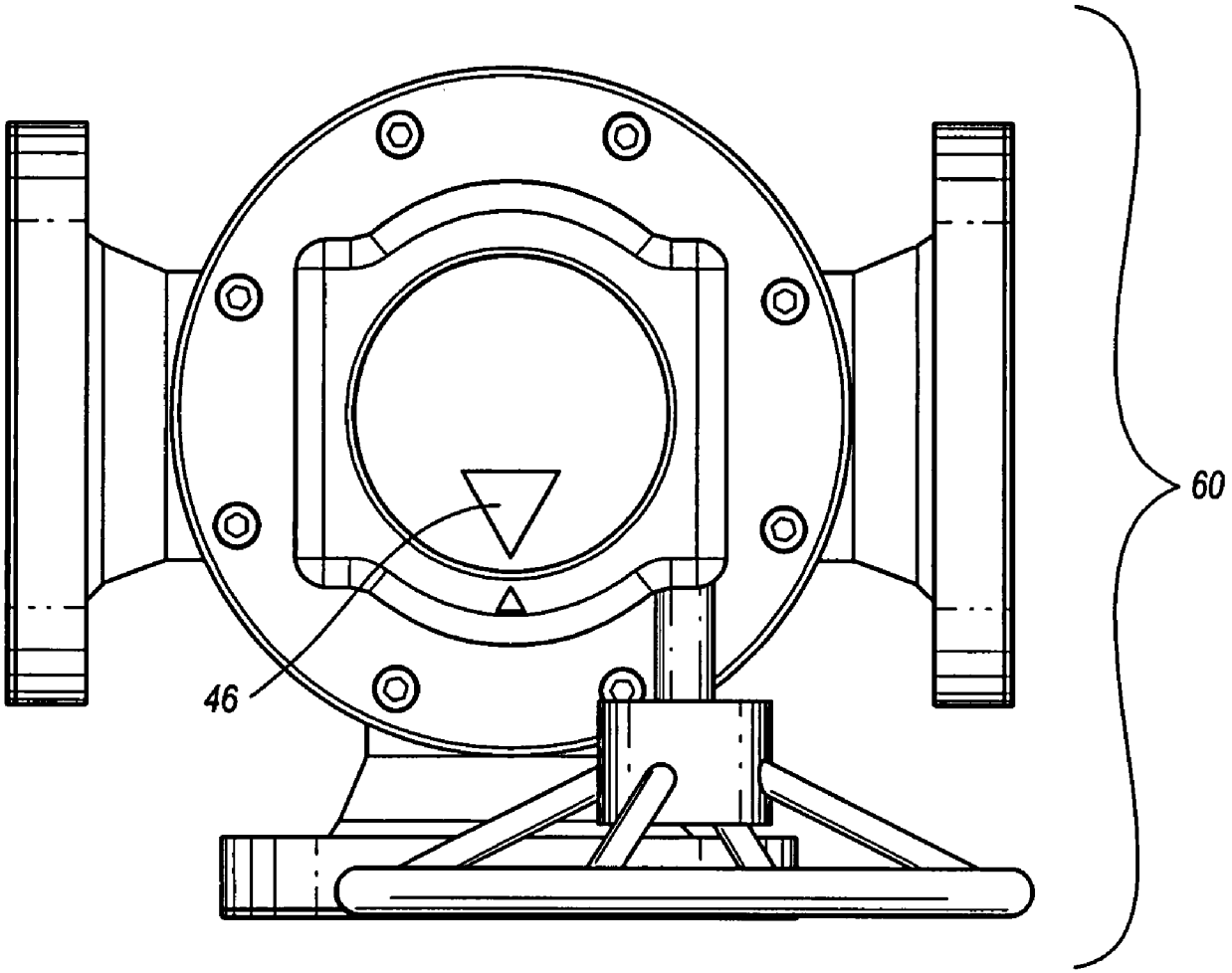
FIG. 5 depicts the 3-way ball valve viewed from the top surface.
Figure 6:
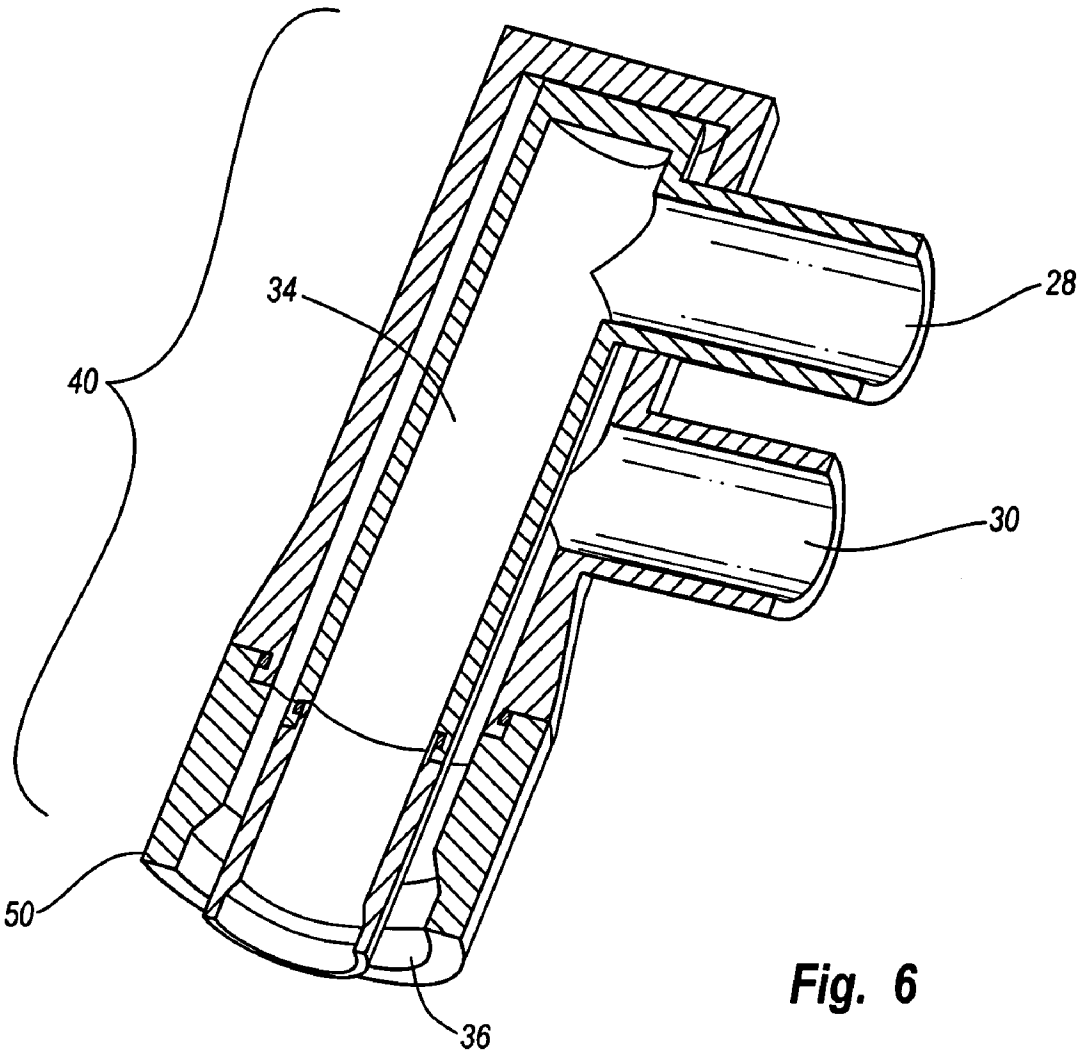
FIG. 6 depicts the union of the high pressure pipes containing fluids used for boring with the high pressure pipe containing fluids used for cutting.
Figure 7:
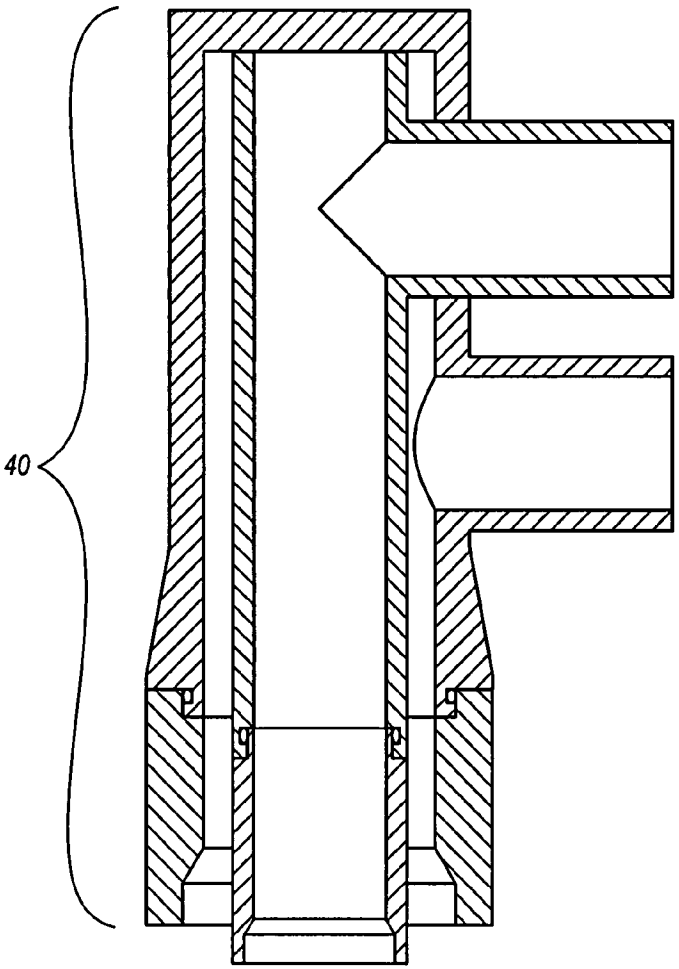
FIG. 7 depicts the union of the high pressure pipe containing fluids used for boring with the high pressure pipe containing fluids used for cutting.

The present invention relates to a system for removing "coke," solid carbonaceous residue, from large cylindrical vessels called coke drums. This removal process is often referred to as "decoking." More particularly, the present invention relates to a system that allows an operator to remotely activate the cutting of coke within a coke drum and at the same time, apprises the operator of the status of the cutting modes taking place within the coke drum during the coke-cutting process.

The presently preferred embodiments of the invention will be best understood by reference to the drawings wherein like parts are designated by like numerals throughout. Further the following disclosure of the present invention is grouped into two subheadings, namely "Brief General Discussion on Delayed Coking and Coke-Cutting" and "Detailed Description of the Present Invention." The utilization of the subheadings is for convenience of the reader only and is not to be construed as limiting in any sense.

It will be readily understood that the components of the present invention, as generally described and illustrated in the figures herein, could be arranged and designed in a wide variety of different configurations. Thus, the following more detailed description of the embodiments of the system, device and method of the present invention, and represented in FIGS. 1 through 4, is not intended to limit the scope of the invention, as claimed, but is merely representative of the presently preferred embodiments of the invention.

BRIEF GENERAL DISCUSSION ON DELAYED COKING AND COKE-CUTTING

In the typical delayed coking process, high boiling petroleum residues are fed into one or more coke drums where they are thermally cracked into light products and a solid residue-petroleum coke. The coke drums containing the coke are typically large cylindrical vessels. The decoking process is a final process in the petroleum refining process and, once a process known as "de-heading" has taken place, the coke is removed from these drums by coke-cutting means.

In the typical delayed coking process, fresh feed and recycled feed are combined and fed through a line from the bottom of the fractionator. The combined feed is pumped through a coke heater and heated to a temperature between about 800° F. to 1000° F. The combined feed is partially vaporized and alternatively charged into a pair of coker vessels. Hot vapor expelled from the top of the coker vessel are recycled to the bottom of the fractionator by a line. The unvaporized portion of the coker heater effluent settles out (cokes) in an active coker vessel, where the combined effect of temperature and retention time result in coke formation. Coke formation in a coker vessel is continued typically between twelve and thirty hours, until the active vessel is full. Once the active vessel is full the heated heavy hydrocarbon feed is redirected to an empty coker vessel where the above described process is repeated. Coke is then removed from the full vessel by first quenching the hot coke with steam and water, then opening a closure unit sealed to the vessel top, hydraulically drilling the coke from the top portion of the vessel, directing the drilled coke from the vessel through an open coker bottom unit through an attached coke chute to a coke receiving area. Opening the closure unit is safely accomplished by a remotely located control unit.

Decoking is accomplished at most plants using a hydraulic system consisting of a drill stem and drill bit that direct high pressure water jets into the coke bed. A rotating combination drill bit, referred to as the cutting tool, is typically about eighteen inches in diameter with several nozzles, and is mounted on the lower end of a long hollow drill stem about six inches in diameter. The drill bit is lowered into the vessel, on the drill stem, through a flanged opening at the top of the vessel. A "bore hole" is drilled through the coke using the nozzles, which eject high pressure water (2600–3600 p.s.i.) at an angle approximately sixty degrees down from horizontal. This creates a pilot bore hole, about three to six feet in diameter, for the coke to fall through.

After the initial bore hole is complete, the drill bit is then mechanically switched to at least two horizontal nozzles in preparation for cutting the "cut" hole, which extends to the full drum diameter. In the cutting mode the nozzles shoot jets of water horizontally outwards, rotating slowly with the drill rod, and those jets cut the coke into pieces, which fall out the open bottom of the vessel, into a chute that directs the coke to a receiving area. In all employed systems the drill rod is then withdrawn out the flanged opening at the top of the vessel. Finally, the top and bottom of the vessel are closed by replacing the head units, flanges or other closure devices employed on the vessel unit. The vessel is then clean and ready for the next filling cycle with the heavy hydrocarbon feed.

In the typical coke-cutting system, after the boring hole is made, the drill stem must be removed from the coke drum and reset to the cutting mode. This takes time, is inconvenient and potentially hazardous. In less typical systems the modes are automatically switched. Automatic switching within the coke drum oftentimes results in drill stem clogging, which still requires the drill stem to be removed for cleaning prior to completing the coke-cutting process. Often, in automatic switching systems, it is difficult to determine whether or not the drill stem is in cutting or boring mode, because the entire change takes place within the drum. Mistakes in identifying whether the high pressure water is cutting or boring leads to serious accidents. Thus, coke-cutting efficiency is compromised because the switching operator does not know whether or not the cutting process is complete or simply clogged.

The present invention describes a method and system for coke-cutting in a coke drum following the manufacturing of coke therein. As the present invention is especially adapted to be used in the coking process, the following discussion will related specifically in this manufacturing area. It is foreseeable, however, that the present invention may be adapted to be an integral part of other manufacturing processes producing various elements other than coke, and such processes should thus be considered within the scope of this application.

DETAILED DESCRIPTION OF PRESENT INVENTION

The present invention comprises several objectives, which achieve previously unknown models of efficiency and safety in the art. Accordingly, it is an object of some embodiments of the present invention to provide a system for cutting coke that is controlled from a remote location through an external switching mechanism. The present invention provides a system for coke-cutting wherein the drill stem 52 does not need to be removed to change from boring to cutting mode, but rather, modes can be changed remotely. The present invention provides a system for coke-cutting wherein the rotatable integrated boring and cutting drill stem 52 does not clog because switching is controlled by a remote switch 42, precluding both modes from operating simultaneously. The present invention provides a system for coke-cutting wherein a physical symbol 46 is connected to said switch valve so that the operational status, i.e., boring and cutting modes, is manifested externally to an operator. The present invention provides a system for coke-cutting can be used with current coke-cutting techniques.

Figure 9:
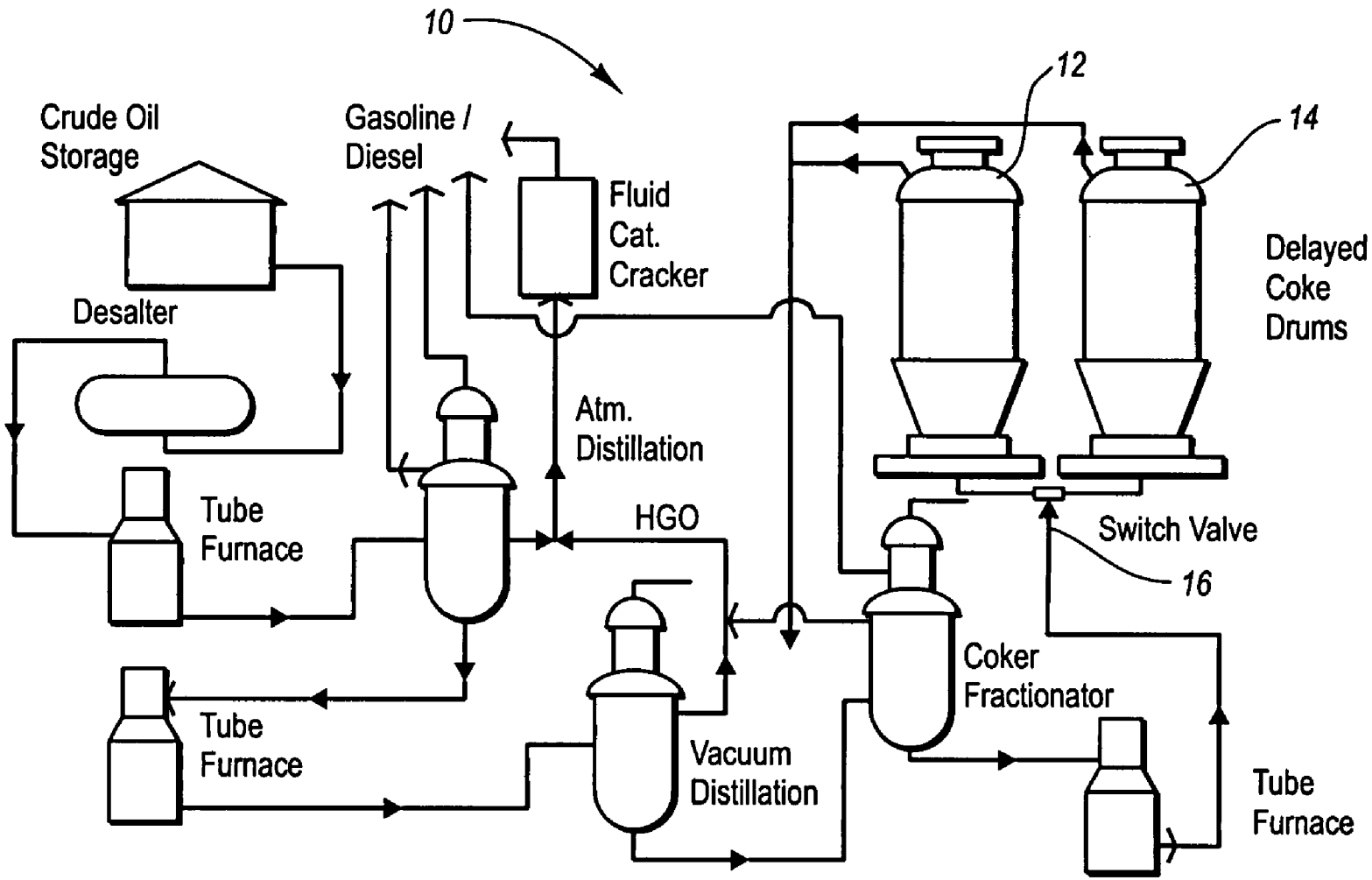
FIG. 9 depicts generally, the refinery process, wherein coke is manufactured from the refinery by-products in a series of coke drums.

FIG. 9 depicts a petroleum manufacturing and refinery process 10 having several elements and systems present (identified, but not discussed). In addition to these elements, petroleum manufacturing and refinery process 10 includes first and second delayed coke drums 12 and 14, respectively. There are typically two coke drums in simultaneous operation so as to permit the ongoing manufacture and refinery of petroleum as well as its coke byproduct. While first coke drum 12 is online and being filled via a feed inlet 16, second coke drum 14 is going through a decoking process to purge the manufactured coke contained therein.

Figure 10:
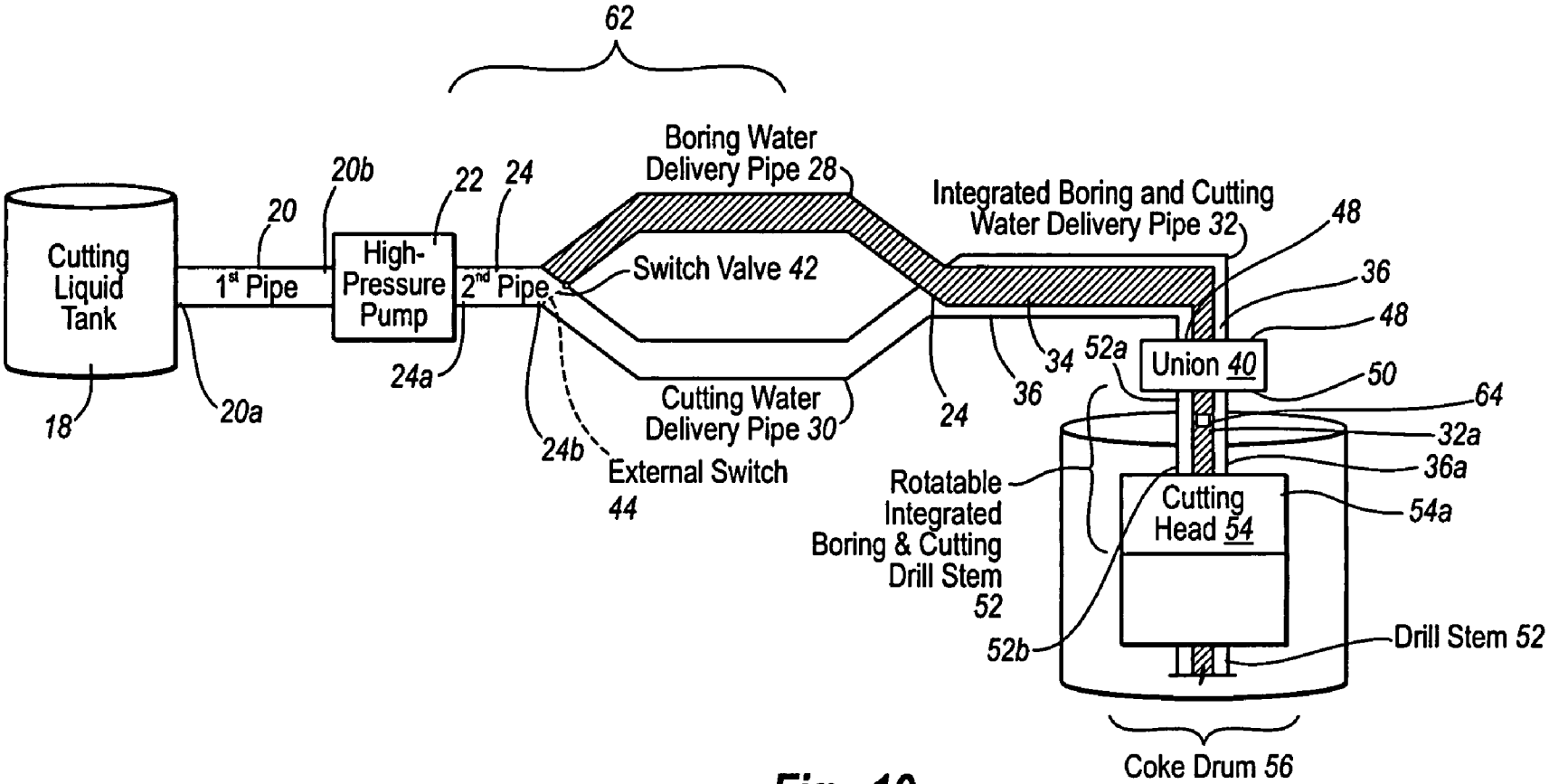
FIG. 10 depicts the coke cutting system and device of the presently described invention.

FIG. 10 depicts a preferred embodiment of the present invention. In this figure, the system comprises a cutting liquid tank 18 filled with water, or other liquid. A first pipe 20 is attached to this tank 18 and water flows from it into a high-pressure pump 22. The first pipe has a first end 20*a* that is attached to the cutting liquid tank 18 and a second end 20*b* that is attached to the high-pressure pump 22. In the high-pressure pump 22, the water is pressurized. After leaving the high-pressure pump 22, the pressurized water then flows into a second pipe 24 with a first end 24*a* and a second end 24*b*. Said second pipe 24, at said second end 24*b*, divides into two pipes. One of the two pipes created from this division is a boring water delivery pipe 28 and the other is a cutting water delivery pipe 30. In one embodiment of the present invention the two pipes created from the division of the high pressure water pipe 24 into a boring water delivery pipe 28 and a cutting water delivery pipe 30 is accomplished by utilizing a three-way ball valve 60.

The three-way ball valve 60 is operated mechanically by an operator at a location remote from the decoking process. The three-way ball valve is actuated by an actuation switch 61. The three-way ball valve 62 of the present invention is comprised of three exterior flanges. A first flange 68 attaches to the second water pipe 24. High pressure water that leaves the high pressure pump 22 moves through the second water pipe and enters the three-way ball valve 60 through a connection between the second water pipe 24 and the first flange 68. The three-way ball valve is further comprised of two outlets, a first outlet 69*a* and a second outlet 69*b*. The first outlet 69*a* connects the flow of high pressure fluids to the boring nozzles 57 of the cutting head 54 to begin decoking a coke barrel 12. The second flange 69*b* connects to a water delivery pipe for the cutting nozzle 58, of the cutting head 54 for decoking barrels 12. Thus, the three-way ball valve 60 allows high pressure fluids to flow into the system through the inlet flange 68 and to be segregated into the outlet flange 69*a* connected to the boring water delivery pipe 28, or into the outlet flange 69*b* connected to the cutting water delivery pipe 30, or for the high pressure fluid to be turned off to both pipes. The boring water delivery pipe 28 has a first end 28*a* and a second end 28*b*. The first end of the boring water pipe 28 connects to the first outlet flange 69*a* of the three-way ball valve 60. The second end of the boring water delivery pipe 28 connects to the union 40. The present invention is further comprised of a cutting water delivery pipe 30, which has a first end 30*a* and a second end 30*b*. The first end 30*a* is connected to the second outlet 69*b* of the three-way ball valve 60. The second end of the cutting water pipe 30*b* is connected to the union 40.

The two pipes 28, 30 that extend from the three-way ball valve 60 are the boring water delivery pipe 28 and the cutting water delivery pipe 30. They extend parallel to each other for a distance. After such a distance, at a union 40, the two delivery pipes 28, 30 integrate to form an integrated boring and cutting water delivery pipe 32. This integrated boring and cutting water delivery pipe 32 appear as a "pipe within a pipe." Specifically, the boring water delivery pipe 28 becomes an inner pipe 34, while the cutting water delivery pipe 30 concentrically encompasses the boring water delivery pipe 28 on the outside becoming an outer pipe 36. The two pipes (34, 36) do not fluidly communicate with each other, but rather, enable the pressurized water to flow into either of the two pipes (34, 36), yet flow in the same overall device, which is the integrated boring and cutting water delivery pipe 32. At a second end of the integrated boring and cutting water delivery pipe 32, the integrated boring and cutting water delivery pipe 32 attaches to a boring and cutting device 52.

Where the second pipe 24 divides, a switch valve 42 exists that is comprised of an external switch 44. The switch valve 42 prevents the pressurized water from flowing into both pipes (28, 30) simultaneously. The switch valve 42, through activation of the external switch 44, enables fluid to flow into either the boring water delivery pipe 28 or the cutting water delivery pipe 30, but not into both at the same time. A symbol 46 appears that manifests externally to the operator which pipe 28 or 30 the pressurized water is in.

The present invention is comprised of systems and methods which allow an operator to remotely change a flow of high pressured fluids between the boring and cutting modes during the decoking process. The second end of the boring water delivery pipe 28*b* and the second end of the cutting water delivery pipe 30*b* intersect and integrate at a union 40. The refinery operator first switches the switch valve 42 by the external switch 44 so that the pressurized water flows into the boring water delivery pipe 28. The symbol 46 is then activated indicating water is in the boring water delivery pipe 28 and the system is in the boring mode. When the operator has completed boring, he or she then switches the switch valve 42, resetting it so that the pressurized water flows into the cutting water delivery pipe 30. The symbol 46 reflects this change.

From a lower part 50 of the union 40, a rotatable integrated boring and cutting drill stem 52, having a first end 52*a* and a second end 52*b*, and with similar dimensions and diameters as the integrated boring and cutting delivery pipe 32, extends vertically downward. A motor is located within said rotatable integrated boring and cutting drill stem 52. The motor is activated by the external switch described above. The similarity in dimensions enables the integrated boring and cutting water delivery pipe 32 to fluidly communicate with the rotatable integrated boring and cutting drill stem 52. At the same time, the union 40 between the two pipes (32, 52) prevents the integrated boring and water delivery pipe 32 from rotating yet allows the rotatable integrated boring and cutting drill stem 52 to rotate. Thus, the union 40 merely serves to connect the integrated boring and cutting water delivery pipe 32 with the rotatable integrated boring and cutting drill stem 52. The rotatable integrated boring and cutting drill stem 52 connects to the union's 40 lower end 50 and, similarly to the integrated boring and cutting water delivery pipe 32.

The rotatable integrated boring and cutting drill stem 52 has an inner pipe 34*a* and an outer pipe 36*a*. At a lower end 50 of the rotatable integrated boring and cutting drill stem 52, there is a cutting head 54 with orifices 57, 58 that allow the pressurized water to be ejected therethrough, and to cut the coke away from the interior of the coke drums 12. The water ejects from the cutting head 54 either through a nozzle or a plurality of nozzles 57 attached to the cutting head 54 to accomplish the bore hole.

A rotating combination drill bit referred to as the cutting tool is about eighteen inches in diameter with several nozzles, and is mounted on the lower end of the long hollow drill stem, which is about six inches in diameter. The cutting head 54 is comprised of a plurality of nozzles 57, 58. The plurality of nozzles 57, 58 are separated into two categories. One set of nozzles 57 allow high pressure fluids to eject from the cutting head 54 to drill a bore hole initially through the coke in the coke barrel. The second set of nozzles 58 eject high pressure fluid from the cutting head 54 perpendicular to a rotatable integrated boring and cutting drill stem 52. Thus, water which is ejected from the first set of nozzles 57 produce the initial boring hole, while water ejected from the second set of nozzles 58 cut away and dislodge the remaining coke from the coke barrel 12.

The rotatable integrated boring and cutting drill stem 52 may also be activated by the switch valve 42. While the switch valve 42 is allowing the pressurized water to flow into the boring water delivery pipe 28, the rotatable integrated boring and cutting drill stem 52 begins to descend into a coke drum 12. As the drill stem 52 descends, pressurized water enters the rotatable integrated boring and cutting drill stem 52. The pressurized water flows through the inner pipe 34*a* into the cutting head 54 is ejected from the boring nozzle(s) 57 and bores through the coke. Either at the bottom of the coke drum 12, or after the rotatable integrated boring and cutting drill stem 52 is lifted to the top of the coke drum 12 container (but not outside the container), the switch valve 42 is then actuated, allowing the pressurized water to flow into the cutting water delivery pipe 28. The pressurized water enters the outer pipe 36*a* of the rotatable boring and cutting drill stem 52, flows through the cutting head 54 and is ejected from the cutting nozzle 58 to continue cutting coke away from the interior of the coke drum 12. Consequently, after boring is completed, the switch valve 42 is actuated, and the pressurized water f lows into the cutting water delivery pipe 30, into the outer pipe 36 of the integrated boring and cutting water delivery pipe 32, through the union 40, into the outer pipe 36*a* of the rotatable integrated boring and water delivery pipe 52 through a cutting head 54 at the bottom of the rotatable integrated boring and cutting drill stem 52 where the pressurized water ejects from cutting nozzles 58 perpendicularly to the drill stem 52 and cuts the coke.

The system 62 as a whole can be applied to, or modified to fit, current coke-cutting systems. Specifically, the system 62 as described can be applied to currently operating coke-cutting overhead gantries and used in typical coke-cutting systems. Thus, the entire process is activated by the switch valve 42 located where the second pipe 24 divides into the boring side water delivery pipe 28 and the cutting water side delivery pipe 30. The process is controlled by the external switch mechanism 44 and, therefore, the operator is able to determine through the entire coke-cutting process which mode, either boring or cutting, the rotatable integrated boring and cutting drill stem 52 is in.

Figure 8:
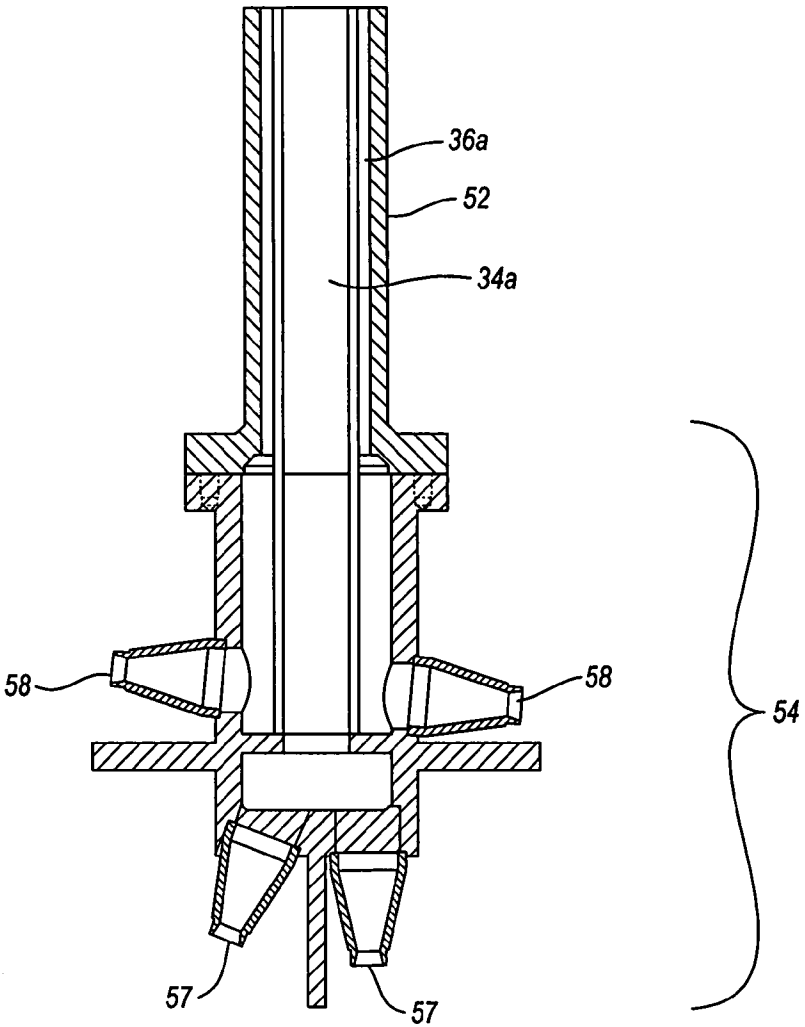
FIG. 8 depicts the cutting head.

FIG. 8 depicts an enlarged view of the rotatable integrated boring and cutting drill stem 52 as it enters the coke drum 56. The rotatable integrated boring and cutting drill stem 52 may either bore down then cut up, or, bore down, and then be pulled up to cut down again, the latter of which is represented by this figure.

EXAMPLE 1

The present invention relates to a system for removing coke, solid carbonaceous residue, from large cylindrical vessels called coke drums 12. The present invention relates to a system that allows an operator to remotely activate the cutting of coke within a coke drum 12, and to remotely switch between the "boring" and the "cutting" modes while cutting coke within a coke drum 12 reliably, without raising the cutting head 54 out of the coke drum 12 for mechanical alteration or inspection. Further, the present invention allows an operator to apprise the status of the cutting modes taking place within the coke drum 12 during the coke-cutting process. Hence, the present invention provides a system for cutting coke within a coke drum 12 with increased safety, efficiency and convenience.

One embodiment of the present invention features the use of a three-wall ball valve 60, a union 40, and a specialized cutting head 54. In this preferred embodiment, the system is comprised of a cutting liquid tank filled with water or other liquid. A pipe 20 is attached to this tank 18 and water flows from it into a high-pressure pump 22. In the high-pressure pump, the water is pressurized. After leaving the high-pressure pump 22, the pressurized water then flows into another pipe 24 that, at a second end 24*b*, divides into two pipes 28, 30. One of the two pipes 28, 30 created from this division is a boring water delivery pipe 28 and the other is a cutting water delivery pipe 28. In one embodiment of the present invention the delivery pipe is separated into two pipes by a three-way ball valve 60. The three-way ball valve 60 prevents the pressurized water from flowing into both pipes, the boring water delivery pipe 28 and the cutting water delivery pipe 30, simultaneously. Further, an operator may visualize with certainty which pipe the boring water delivery pipe 28 or the cutting water delivery pipe 30, the pressurized water is in, and consequently, the status of coke-cutting mode within the coke drum 12.

The two pipes 28, 30 extend parallel to each other for a distance. After such a distance, the two delivery pipes integrate to form an integrated boring and cutting water delivery pipe 32. This integrated boring and cutting water delivery pipe 32 appears as a "pipe within a pipe." Specifically, the boring water delivery pipe 28 becomes an inner pipe 34, while the cutting water delivery pipe 30 concentrically encompasses the boring water delivery pipe on the outside becoming an outer pipe 36. The two pipes do not fluidly communicate with each other, but rather, enable pressurized fluid to flow through either of the two pipes, yet flow in the same overall device, the cutting head 54. Because the switch valve allows water to flow only through either the inner, boring water delivery pipe 34, or the outer delivery pipe 42, cutting water deliver pipe 36, water is delivered only to boring 57 or cutting 59 outlet nozzles of the cutting head respectively.

The integrated boring and cutting water delivery pipe 32 attaches to, or is an integral part of a union 40. From a lower part of the union 40, a rotatable integrated boring and cutting drill stem 52, with similar dimensions and diameters as the integrated boring and cutting delivery pipe 32, extends vertically downward. This rotatable integrated boring and cutting drill stem 52 features a motor that is also activated by the external switch. The motor enables the drill stem to rotate. The similarity in dimensions enables the integrated boring and cutting water delivery pipe 32 to fluidly communicate with the drill stem 52. At the same time, the union 40 between the two pipes prevents the integrated boring and water delivery pipe 32 from rotating yet allows the rotatable integrated boring and cutting drill stem 52 to rotate. The rotatable integrated boring and cutting drill stem 52 has an inner pipe and an outer pipe. At a lower end of the drill stem 52*b*, there is a cutting head 54. The cutting head is comprised of nozzles (57, 58), which allow the pressurized water to be ejected therethrough to cut the coke away from the interior of the coke drums. The boring nozzles 58 eject high pressure fluid in a downward angle to produce the bore hole, and the cutting nozzles 58 eject high pressure fluid in a direction roughly perpendicular to the drill stem.

The rotatable integrated boring and cutting drill stem 52 is activated by an remote switching means. After the cutting head 54 has been inserted into the top of the coke drum 12, pressurized fluids are ejected through a plurality of nozzles (57 or 58) of the cutting head 54 at a pressure sufficient to cut and dislodge coke from the vessel 12. Initially, pressurized fluids are allowed to flow into the boring water delivery pipe 28 when an operator actuates the switch valve 42. As the cutting head 54 descends through the coke barrel 12, pressurized liquid enters the drill stem 52 through the inner pipe 34 ejecting fluid through a plurality of nozzles 57 attached to the cutting head at a pressure sufficient to bore coke from the vessel. Thus, a bore hole is drilled through the coke using the nozzle 57 or plurality of nozzles 57, which eject high pressure liquids in a downward direction from the cutting head 54. After the initial bore hole is completed the flow of high pressure fluid is remotely switched to a plurality of nozzles 58 attached to the cutting head 54 at a pressure sufficient to cut and dislodge the remainder of coke from the vessel 12. This switching is accomplished by actuating a switch valve 42, 60, which is in a position remote from the coke barrel 12. In one embodiment of the present invention the operator remotely switches the flow of fluid from the boring nozzles 57 to the cutting nozzles 58 by turning the handle, actuating a lever 61, of a three-way ball valve 60, which is in a location remote from the vessel 12 being decoked. Thus, when the cutting head 54 has successfully completed its boring stroke the switch valve 42 is activated allowing pressurized fluid to flow into the cutting water delivery pipe 30. The pressurized fluid then enters the outer pipe 36 of the drill stem 52 and is ejected from the cutting nozzles 58 of the cutting head 54 to continue cutting the coke away from the interior of the coke drum 12. Subsequently, the remainder of coke in the drum 12 is cut and dislodged from the vessel 12.

Thus, the entire boring and cutting processes are activated by the external switch 61, which activates the switch valve 42 located where the pipe 24 divides into the boring water delivery pipe 28 and the cutting water delivery pipe 30. The process is controlled by the external switch mechanism 61 and, therefore, the operator is able to determine through the entire coke-cutting process which mode, either boring or cutting the rotatable integrated boring and cutting drill stem 52 is in without having to remove the cutting head 54 from the coke drum 12.

In some embodiments, the switch valve 42 is controlled by a central processing unit, or other means, rather than a live operator. Thus, it is contemplated by the present invention that the switch valve 42 could be controlled from a control room wherein an operator remotely controls the entire decoking process utilizing mechanical and electrical apparatus to remotely dictate the decoking process.

The present invention may be embodied in other specific forms without departing from its spirit of essential characteristics. The described embodiments are to be considered in all respects only illustrative and not restrictive. The scope of the invention is, therefore, indicated by the appended claims, rather than by the foregoing description. All changes that come within the meaning and range of equivalency of claims are to be embraced within their scope.

What is claimed is:

1. A system for removing coke from a coking vessel comprising:

a cutting head with a plurality of nozzles separated into two groups, one group for boring and one for cutting;

a pipe fluidly connected to the boring nozzles; and a pipe fluidly connected the cutting nozzles, wherein the pipe connected to the cutting nozzles concentrically encompasses the pipe fluidly connected to the boring nozzles.

2. The system of claim 1, wherein the cutting head is controlled by a central processing unit.

3. A system as in claim 1, further comprising a switch valve, wherein said switch valve segregates high-pressure fluid into separate delivery pipes, wherein said delivery pipes consist of at least one delivery pipe for boring and at least one delivery pipe for cutting, wherein said delivery pipes deliver fluid to a cutting head.

4. The system of claim 3, wherein the switch valve is a three way ball joint.

5. The system as in claim 3, further comprising one or more visual markers that indicate whether high pressure fluid is flowing, and into which delivery pipe the fluid is flowing.

6. The system of claim 3, wherein said switch valve is controlled by a central processing unit.

7. The system of claim 3, wherein said switch valve and cutting head are controlled remotely from a control room.

8. The system of claim 3, wherein the switch valve is manually actuated by an operator.

9. A system as in claim 1, further comprising an integrated boring and cutting water delivery pipe, which begins where said boring water delivery pipe and said cutting water delivery pipe connect and integrate.

10. A system as in claim 1, further comprising a rotatable integrated boring and cutting drill stem having a cutting head and a motor.

11. A system as in claim 10, further comprising a union, wherein said union connects said integrated boring and water delivery pipe to said rotatable integrated boring and cutting drill stem.

12. The system of claim 1, wherein said fluid is water.

13. A system for removing coke from a coking vessel comprising:

a cutting head with plurality of nozzles separated into two groups, one group for boring and one for cutting, each independently supplied by fluid;

a switch valve, wherein said switch valve segregates high-pressure fluid into separate delivery pipes, wherein said delivery pipes consist of at least one delivery pipe for boring and at least one delivery pipe for cutting, wherein said delivery pipes deliver fluid to a cutting head;

an intergrated boring and cutting water delivery pipe, which begins where said boring water delivery pipe and said cutting water delivery pipe connect and intergrate;

wherein said cutting water delivery pipe concentrically encompasses the boring water delivery pipe;

a rotatable intergrated boring and cutting drill stem having a cutting head and a motor;

a union, wherein said union connects said intergrated boring and water delivery pipe to said rotatable intergrated boring and cutting drill stem.

14. A method for removing coke from a coking vessel comprising:

ejecting high pressure fluid from a cutting head with plurality of nozzles separated into two groups, one group for boring and one for cutting, each independently supplied by fluid; wherein said fluid is supplied by a pipe system comprising: a pipe fluidly connected to the boring nozzles; and a pipe fluidly connected to the cutting nozzles, wherein the pipe connected to the cutting nozzles concentrically encompasses the pipe fluidly connected to the boring nozzles.

15. The method of claim 14, wherein the cutting head is controlled by a central processing unit.

16. A method as in claim 14, further comprising the step of segregating high-pressure fluid into separate delivery pipes with a switch valve, wherein said delivery pipes consist of at least one delivery pipe for boring and at least one delivery pipe for cutting, wherein said delivery pipes deliver fluid to a cutting head.

17. The method of claim 16, wherein said switch valve is a three way ball joint.

18. The method as in claim 16, further comprising one or more visual markers that indicate whether high pressure fluid is flowing, and into which delivery pipe the fluid is flowing.

19. The method of claim 16, wherein said switch valve is controlled by a central processing unit.

20. The method of claim 16, wherein said switch valve and cutting head are controlled remotely from a control room.

21. The method of claim 16, wherein the switch valve is manually actuated by an operator.

22. A method as in claim 14, further comprising the step of enabling high pressure fluid to flow into an integrated boring and cutting water delivery pipe, which begins where said boring water delivery pipe and said cutting water delivery pipe connect and integrate.

23. A method as in claim 14, further comprising the step enabling high pressure fluid to flow into a rotatable integrated boring and cutting drill stem having a cutting head and a motor.

24. A method as in claim 23, further comprising the step of enabling high pressure fluid to flow into a union, wherein said union connects said integrated boring and water delivery pipe to said rotatable integrated boring and cutting drill stem.

25. The method of claim 14, wherein said fluid is water.

26. A method for removing coke from a coke vessel, comprising the steps of:

pressurizing liquid;

enabling, via a switch valve said pressurized liquid to enter into a boring water delivery pipe and into a cutting water delivery pipe alternatively, enabling said boring water delivery pipe and said cutting water delivery pipe to connectably form into an integrated boring and cutting water delivery pipe having an inner pipe and an outer pipe;

connecting said integrated boring and cutting water delivery pipe to an upper end of a union, which also has a lower end;

connecting a rotatable integrated boring and cutting drill stem having an inner and outer pipe, to said lower end of said union;

wherein said cutting water delivery pipe concentrically encompasses the boring water delivery ripe;

lowering said rotatable integrated boring and cutting drill stem into a coke drum containing coke;

switching said switch valve to allow said pressurized liquid to enter into said boring water delivery pipe, then into said inner pipe of said integrated boring and cutting water delivery pipe, through said union, and finally, into said inner pipe of said rotatable boring and cutting water drill stem, to a cutting head;

ejecting high pressure fluid from nozzles dedicated to boring on a cutting head to begin boring a hole through said coke, wherein said cutting head is comprised of a plurality of nozzles separated into two groups, one group for boring and one for cutting, each independently supplied by fluid switching said switch valve to allow said pressurized liquid to enter into said cutting water delivery pipe, then into said outer pipe of said integrated boring and cutting water delivery pipe, through said union, into said outer pipe of said rotatable boring and cutting water drill stem, and finally through said cutting head;

ejecting high pressure fluid from nozzles dedicated to cutting coke on a cutting head to begin cutting said coke within said coke vessel; wherein said cutting head is comprised of a plurality of nozzles separated into two groups, one group for boring and one for cutting, each independently supplied by fluid;

symbolizing to an operator when said pressurized liquid is in said boring water delivery pipe and when said pressurized liquid is in said cutting water delivery pipe, and therefore, in said boring mode or cutting mode, respectively.

* * * * *